United States Patent [19]

Nagaoka

[11] Patent Number: 4,710,148

[45] Date of Patent: Dec. 1, 1987

[54] TOY VEHICLE ASSEMBLY WITH MULTIPLE DRIVE UNITS

[75] Inventor: Junichi Nagaoka, Misato, Japan

[73] Assignee: Takara Co., Ltd., Tokyo, Japan

[21] Appl. No.: 921,674

[22] Filed: Oct. 21, 1986

[30] Foreign Application Priority Data

Oct. 23, 1985 [JP] Japan ..... 60-162712[U]

[51] Int. Cl.[4] ..... A63H 29/00

[52] U.S. Cl. ..... 446/464; 446/95

[58] Field of Search ..... 446/459, 457, 462, 464, 446/95

[56] References Cited

U.S. PATENT DOCUMENTS

| | | | |
|---|---|---|---|
| 1,427,790 | 9/1922 | Earley | 446/459 |
| 4,027,421 | 6/1977 | Allen . | |
| 4,468,884 | 9/1984 | Goldfarb et al. | 446/462 |
| 4,470,219 | 9/1984 | Sugimoto | 446/464 |
| 4,684,355 | 8/1987 | Urakawa et al. | 446/464 |

FOREIGN PATENT DOCUMENTS

| | | |
|---|---|---|
| 913274 | 12/1962 | United Kingdom . |
| 1340641 | 12/1973 | United Kingdom . |
| 2014861A | 9/1979 | United Kingdom . |
| 2094165 | 9/1982 | United Kingdom . |
| 2097686 | 11/1982 | United Kingdom . |
| 2134399 | 8/1984 | United Kingdom . |

*Primary Examiner*—Mickey Yu

*Attorney, Agent, or Firm*—Price, Gess & Ubell

[57] ABSTRACT

A toy vehicle having a chassis and interchangeable wheel drive units detachably mounted in container portions of the chassis. The wheel drive units has a unit body and a pair of wheels rotatably mounted to the unit body via a rotary shaft.

6 Claims, 4 Drawing Figures

TOY VEHICLE ASSEMBLY WITH MULTIPLE DRIVE UNITS

BACKGROUND OF THE INVENTION

The present invention relates to a toy vehicle and, more particularly, to a toy vehicle including interchangeable wheel drive units detachably mounted on a chassis of a toy automobile, toy train or the like.

In a conventional toy vehicle such as an automobile, a train, a locomotive, a carriage and the like, wheels are rotatably mounted on a chassis through rotary shafts, and usually the wheels and the rotary shafts cannot be easily detached from the chassis. In another conventional toy vehicle, even when wheels and rotary shafts are detachably mounted on a chassis, such wheels and rotary shafts are not interchangeable with another chassis of a different toy vehicle. Hence, with the conventional toy vehicle, the possibility of the extension of the play is limited, and thus an operator may easily lose interest in the conventional toy vehicle.

SUMMARY OF THE INVENTION

Accordingly, it is an object of the present invention to provide a toy vehicle including interchangeable wheel drive units detachably mounted on a chassis, free from the aforementioned defects and inconveniences of the prior art, which is capable of increasing the possibility of the extension of the play and which is stable and simple in construction.

In accordance with one aspect of the invention, there is provided a toy vehicle comprising a chassis having container portions, and wheel drive units detachably mounted in the container portions of the chassis, the wheel drive unit comprising a unit body and a pair of wheels rotatably mounted to the unit body via a rotary shaft.

Other and further objects, features and advantages of the invention will appear more fully from the following description with references to the preferred embodiment thereof taken in conjunction with the accompanying drawings, in which:

DESCRIPTION OF THE PREFERRED EMBODIMENT

Figure 1:
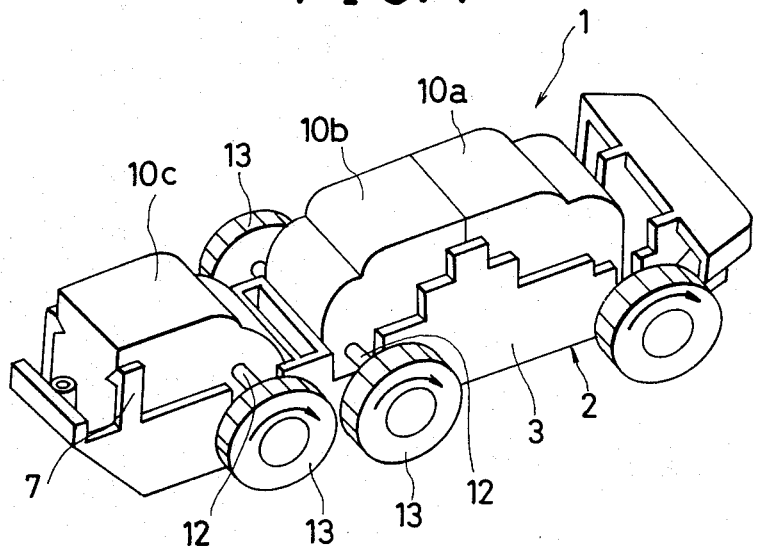
FIG. 1 is a perspective view of a toy vehicle according to the present invention.

Referring now to the drawings, wherein like reference numerals designate similar or corresponding components throughout the different figures, there is shown in FIG. 1 a toy vehicle according to the present invention.

In the drawing, the toy vehicle 1 comprises a chassis 2 and interchangeable wheel drive units 10 detachably mounted on the chassis 2.

Figure 2:
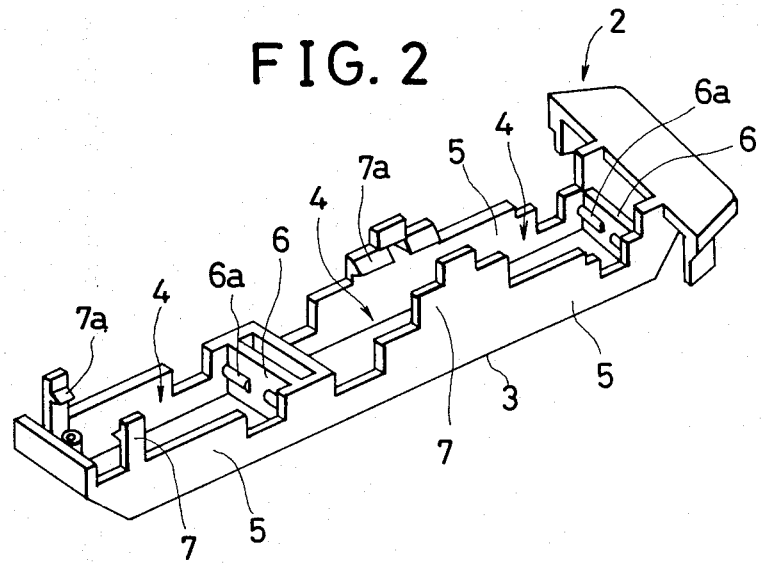
FIG. 2 is a perspective view of a chassis shown in FIG. 1.

As shown in FIG. 2, the chassis 2 comprises a frame 3 having an open upper part, and the frame 3 has three container portions 4 aligned along its longitudinal direction. Each container portion 4 is defined by a pair of side walls 5 facing to each other and a partition wall 6 extending sideways across the frame 3. Each side wall 5 is integrally provided with an engaging plate 7 projecting upwards and the engaging plate 7 is formed with an engaging projection 7*a* on the inner surface in its upper part. The partition wall 6 is formed with a pair of engaging projections 6*a* in its lower part.

Figure 3:
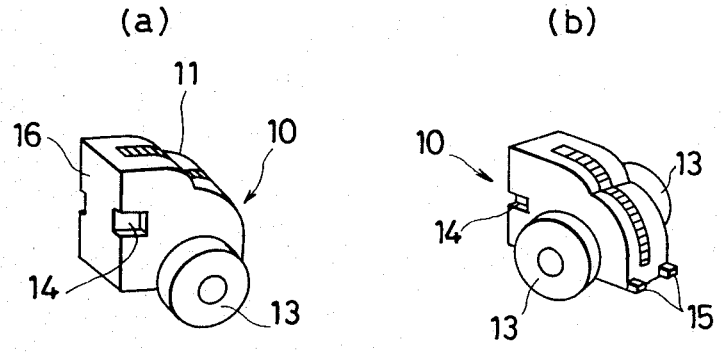
FIGS. 3*a* and 3*b* are perspective views of a wheel drive unit shown in FIG. 1.
Figure 4:
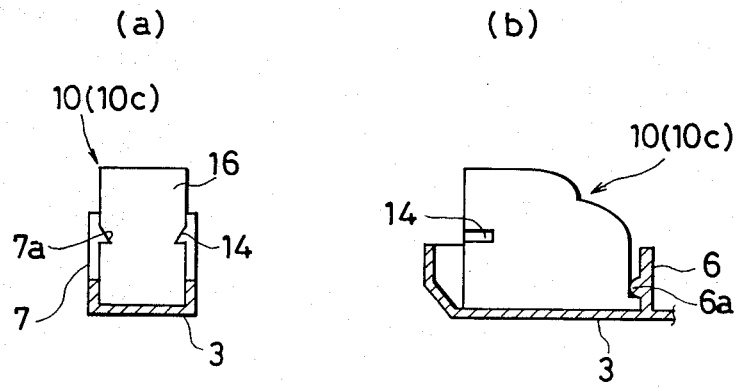
FIGS. 4*a* and 4*b* are end and side views of the wheel drive unit mounted in a container portion of the chassis.

FIGS. 3*a* and 3*b* show the wheel drive unit 10 comprising a unit body 11 of which the front upper portion is gradually diminished, a rotary shaft 12 rotatably mounted to the unit body 11, and a pair of wheels 13 secured onto the rotary shaft 12. The unit body 11 is provided with a pair of grooves 14 on the rear ends of its side walls and a pair of projections 15 on both sides of its lower front. When the wheel drive unit 10 is mounted in the container portion 4 of the chassis 2, as shown in FIGS. 4*a* and 4*b*, the engaging projections 7*a* of the engaging plates 7 engage with the grooves 14 of the side walls of the unit body 11 and the projections 15 of the unit body 11 engage with the engaging projections 6*a* of the partition wall 6.

When the wheel drive unit 10 is constructed as a conventional pullback type, the unit body 11 contains a windup spring drive mechanism comprising a windup spring and a series of gear wheels, and the rotary shaft 12 is an output shaft of the windup spring drive mechanism.

In this embodiment, as shown in FIG. 1, a pair of wheel drive units 10*a* and 10*b* are arranged back to back in the front container portions 4 of the chassis 2 in order to make small the length of the chassis 2, and a wheel drive unit 10*c* is disposed in the rear container portion 4 of the chassis 2. The wheels 13 of the wheel drive unit 10*b* are adapted to rotate in the reverse direction with reference to those of the wheel drive units 10*a* and 10*c*. This reverse rotation of the wheels 13 can be attained by providing one more gear wheel than the others.

When assembling the wheel drive units 10 on the chassis 2, the wheel drive units 10 are pushed into the container portions 4 of the chassis 2 until the front projections 15 and the rear grooves 14 of the wheel drive units 10 are engaged with the engaging projections 6*a* of the partition walls 6 and the engaging projections 7*a* of the engaging plates 7 of the chassis 2, respectively. It is readily understood that assembling and disassembling operations can be readily carried out in a quite simple manner.

Although the three wheel drive units are arranged in series on the chassis in the preferred embodiment taken in conjunction with the accompanying drawings, however, the number, the form and the size of the wheel drive units may be modified at will depending on the shape and the size of the chassis, and so on.

According to the present invention, a variety of toy vehicles having at least 6 wheels may be obtained by a combination of the chassis 2 and the interchangeable wheel drive units 10.

It is readily understood from the above description of the preferred embodiment of the invention, that according to the present invention, toy vehicles having various structures may be obtained freely by a combination of various vehicle bodies and interchangeable wheel drive units, thereby increasing the possibility of the extension of the play. Further, according to the present invention, a toy vehicle having a simple construction may be obtained.

Although the present invention has been described in its preferred embodiment with reference to the accompanying drawings, it is readily understood that various changes and modifications may be made without departing from the spirit and scope of the present invention.

What is claimed is:

1. A combination chassis and multiple drive unit-assembly for a toy vehicle comprising;

a chassis member having a plurality of compartments; and at least a pair of unitary drive units mounted respectively in a pair of compartments, each unitary drive unit includes a body member, a drive mechanism contained in the body member, a rotary shaft connected to the drive mechanism, and a pair of wheels connected to the rotary shaft, the rotary shaft extends on either side of the chassis member to position the respective wheels on the sides of the chassis member, for translation on a support surface, each compartment has means for removably retaining a unitary drive unit and each drive unit body member has complementary retention means for co-acting with the means for retaining whereby a user can selectively insert and remove the unitary drive units in the chassis member compartments.

2. A toy vehicle with multiple drive units comprising:

a chassis having a plurality of separate container portions positioned along the chassis;

a plurality of self-contained drive units are removably mounted in the container portions, each drive unit comprises a unit body supporting a rotary shaft of a dimension to extend on either side of the chassis, each end of the shaft supports a drive wheel, and means in each container portion for removably retaining at least one drive unit.

3. A toy vehicle as defined in claim 2, wherein each wheel drive unit includes a windup spring.

4. A toy vehicle as defined in claim 3, wherein three wheel drive units are detachably mounted in three container portions of the chassis.

5. A toy vehicle as defined in claim 2 wherein at least one container portion is dimensionally structured to receive a pair of drive units, each drive unit being positioned to contact the other drive unit.

6. A toy vehicle as defined in claim 5 wherein each drive unit body has a non-symmetrical identical configuration with a flat vertical surface and the pair of drive units are mounted in a single container portion with their flat vertical surfaces adjacent to each other.

* * * * *